US008310167B2

(12) United States Patent
Ellman et al.

(10) Patent No.: US 8,310,167 B2
(45) Date of Patent: Nov. 13, 2012

(54) ARRANGEMENT FOR CONTROLLING LIGHT EMITTING DIODES

(75) Inventors: Jan Ellman, Karlsrühe (DE); Michael Gültig, Stutensee (DE); Martin Pados, Ettlingen (DE)

(73) Assignee: INIT Innovative Informatikanwendungen in Transport; Verkehrs-und Leitsystemen GmbH, Karlsruhe (DE)

( * ) Notice: Subject to any disclaimer, the term of this patent is extended or adjusted under 35 U.S.C. 154(b) by 295 days.

(21) Appl. No.: 12/802,723

(22) Filed: Jun. 11, 2010

(65) Prior Publication Data

US 2010/0327756 A1 Dec. 30, 2010

(30) Foreign Application Priority Data

Jun. 24, 2009 (DE) ..... 10 2009 030 176

(51) Int. Cl.
*H05B 37/02* (2006.01)

(52) U.S. Cl. ..... 315/209 R; 315/297

(58) Field of Classification Search ..... 315/209 R, 315/297, 224, 225, 291, 307–311
See application file for complete search history.

(56) References Cited

U.S. PATENT DOCUMENTS

| | | | | |
|---|---|---|---|---|
| 7,301,478 | B1 | 11/2007 | Chinn et al. | |
| 7,800,578 | B2 * | 9/2010 | Shih et al. | 345/102 |
| 7,999,491 | B2 * | 8/2011 | Peng et al. | 315/291 |

FOREIGN PATENT DOCUMENTS

| | | |
|---|---|---|
| EP | 1 742 462 | 1/2007 |

* cited by examiner

*Primary Examiner* — Daniel D Chang
(74) *Attorney, Agent, or Firm* — Klaus J. Bach

(57) ABSTRACT

In a circuit arrangement for controlling light emitting diodes (LEDs), which are combined in an indicating table, including a voltage supply, at least one driver which is connected to the voltage supply and has current outputs by way of which current can be supplied to the LEDs as well as at least one control input via which the current being supplied to the LEDs is controllable, a control element is provided by which the number of the LEDs to which current has to be supplied at the same time can be determined and a signal indicative of the number determined can be supplied to the control input of the driver for assisting in controlling the power supply to the LEDs.

10 Claims, 2 Drawing Sheets

ARRANGEMENT FOR CONTROLLING LIGHT EMITTING DIODES

BACKGROUND OF THE INVENTION

The invention resides in an arrangement for the control of light emitting diodes (LEDs) which are combined particularly to a display board, including at least one driver, which has outputs for delivering current to the LEDs and a control input by means of which the current delivered to the LEDs is controllable.

Such an arrangement is well known in the state of the art. For supplying current to the LEDs, a power supply is provided, which, for safety reasons, is generally so dimensioned, that, it can supply all LEDs with the required current at the same time. Because of the large number of LEDs present particularly in an indicating board, the power supply has generally a very large maximum output capacity and thereIS fore is quite large. This is disadvantageous on one hand with respect to the space requirements and, on the other hand, also with respect to the manufacturing expenses.

It is the object of the present invention to provide an arrangement as mentioned above in such a way that a power supply with a relatively low power output capacity can be used.

SUMMARY OF THE INVENTION

In a circuit arrangement for controlling light emitting diodes (LEDs), which are combined in a display board, including a voltage supply, at least one driver which is connected to the voltage supply and has current outputs by way of which current can be supplied to the LEDs as well as at least one control input via which the current being supplied to the LEDs is controllable, a control element is provided by which the number of the LEDs to which current has to be supplied at the same time can be determined and a signal indicative of the number determined can be supplied to the control input of the driver for assisting in controlling the power supply to the LEDs.

Because of the fact that a control element is present by which the number of LEDs to which current needs to be supplied at the same time can be detected, the amount of current to be provided by the respective power supply can be determined and it can be established whether the power supply would be overloaded. Since a signal indicative of the number of LEDs requiring power is supplied to the control input, it is advantageously possible to control the current supplied to the LEDs on the basis of the number of LEDs to be enrgized. In particular, the current supplied to the LEDs can be limited so that it can be made sure that the power supply is not overloaded.

Since it can be made sure that the power supply is not overloaded, a power supply can be used which does not need to be capable to supply the required current to all LEDs at the same time. The power supply may rather be so selected that it can supply current only to a part of the LEDs combined for example in an indicating board.

Since on an indicating board generally only letters or pictures are presented, generally not all the LEDs present on an indicating board are energized at the same time so that not all LEDs need to be supplied with current. If it is for example determined that on average only about 50% of the LEDs combined in an indicating board need to be lit and consequently need to be supplied with current, the power supply can be selected so as to be able to supply current at the same time only to half of the LEDs combined to an indicating board. This is very advantageous with regard to the size and the costs of the power supply to be selected.

If in an arrangement according to the invention with a power supply selected in this way, it is determined by means of the control element that on the indicating board a picture is to be shown for which only half or fewer than half of the LEDs arranged on the indicating board need to be energized, a control signal can be applied to the control input which causes that the maximum admissible current is supplied to the LEDs to be energized for the representation of the particular picture.

If it is determined by means of the control element that for the representation of the respective picture on the indicating board more than half of the LEDs arranged on the indicating board need to be energized, that is, that the maximum output capacity of the power supply would be exceeded, a signal can be supplied to the control input which causes a reduction of the current supplied to the LEDs to be energized to such an extent that the maximum power output capacity of the power supply is not exceeded. This reduces the brightness of the LED display to some extent. But since such a picture content is not normally present, this disadvantage is negligible.

Advantageously, the control element is in the form of a counter. In this way, the number of LEDs of a respective image content to which current needs to be supplied at the same time can easily be determined, since, generally the arrangement includes a microcontroller for controlling the LEDs. The respective image content is therefore already available in digitized form, so that it can easily be determined to which, or respectively, to how many LEDs current has to be supplied.

In a special embodiment, the driver includes an activation input by which the current that can be supplied to the LEDs is controllable. In this way, the current that can be supplied to the LEDs can be controlled by way of a pulse width modulated (PWM) signal.

In a further particular embodiment of the present invention, the driver includes a control input by means of which the current, that can be supplied to the LEDs, is controllable by an analog signal, and which is connected to the output of a voltage source.

In this way, the current to be supplied to the LEDs can be controlled, if applicable, and in addition an adjustment by means of a PWM signal can be made by way of an analog signal. Herein the current supplied to the LEDs could be controlled in the lower range by the PWM signal and, in the higher range, by the analog signal.

If the current supplied to the LEDs, that is the output current of the power supply, is adjusted only in the lower power range, that is not in the upper power range, by a pulse width modulation, it is possible to avoid during the switch-on phase of the PWM signal the occurrence of current peaks, which exceed the maximally admissible output current of the power supply. This could for example occur when an excessive number of LEDs need to be supplied with current at the same time.

When the PWM signal converts to a permanent switch-on signal as the power supply reaches 50% of maximum power output, the power output current of the power supply can be adjusted in the upper range that is in the range of 50 percent to 100% of maximum admissible power output of the power supply by means of the analog signal applied to the control input.

Preferably, the voltage source includes a voltage source control input, by which the output voltage of the voltage source can be controlled. In this way, the current supplied to the LEDs can be controlled in a simple manner. In this embodiment, it is very advantageous if the voltage source control input of the voltage source is connected to an adjustable voltage divider whose overall voltage is adjustable.

In this way, the output voltage of the voltage source and, accordingly, the brightness of the LEDs can be controlled by means of the voltage divider first with a predetermined total voltage applied to the voltage divider in such a way that the brightness of the LEDs corresponds to a basic value with which the indicating board is operated. The basic brightness of a subgroup (board) formed for example by several LEDs controlled by drivers arranged at the control side in a parallel circuit relationship to form an indicating table, can be adjusted by means of the voltage divider. That means the basic brightness of the respective boards can be adapted to the basic brightness of adjacent boards.

By increasing the total voltage applied to the voltage divider, the current flow through all the LEDs to the energized for the respective image content and, as a result, the brightness thereof can be adjusted at the same time.

In a further particular embodiment of the invention, at least one sensor for determining the ambient brightness in the vicinity of the LEDs or respectively the indicating table is provided, wherein a signal indicative of the ambient brightIG is supplied to the control input.

If the ambient brightness changes, for example by sunshine, the brightness of the LEDs should be increased so that the contrast is increased and the table can be read more easily. To this end, the voltage applied to the voltage divider can be increased. This causes also an increase in the voltage provided by the voltage divider and consequently of the voltage provided by the voltage source and an increase of the current flow through the LEDs and, as a result, of the brightness of the LEDs. This however occurs only if it has been determined by means of the control element that the number of LEDs to be energized is sufficiently low so that the maximum acceptable output power of the power supply is not exceeded. If the ambient brightness becomes smaller, the brightness of the LEDs should also be reduced, in order to prevent the indicator from blinding or glaring. To this end, the voltage divider voltage can be reduced whereby the brightness of the LEDs is reduced.

It is advantageous if the last-mentioned embodiment of the invention includes an average value generator for providing an average value of the ambient brightness of the LED over a certain time. In this way, short-time changes of the ambient brightness as they may be caused for example by external light sources or light cover-ups caused for example by passing motor vehicles are evened out.

It is also advantageous if in the last mentioned embodiment several brightness sensors are provided and also a maximum value brightness former is provided for generating the maximum of the output signals of the brightness sensors.

In this way, a consideration of disturbing changes of the ambient brightness as they occur for example when the indicating table is disposed halfway in the shade and halfway exposed to sunshine can be further improved.

In a further particular embodiment of the invention at least one sensor for determining the ambient temperature of the LEDs is provided wherein a signal indicative of the ambient temperature can be supplied to the control input. With such a temperature sensor, the current supplied to the LEDs can advantageously be reduced when the ambient temperature of the LEDs is high. This is very advantageous with respect to the operating life of the LEDs.

It is advantageous if several such temperature sensors are provided as well as a maximum temperature value generator for forming a maximum of the output signals of the temperature sensors.

The invention will become more readily apparent from the following description of a particular embodiment thereof with reference to the accompanying drawings.

DESCRIPTION OF A PARTICULAR EMBODIMENT

Figure 1:
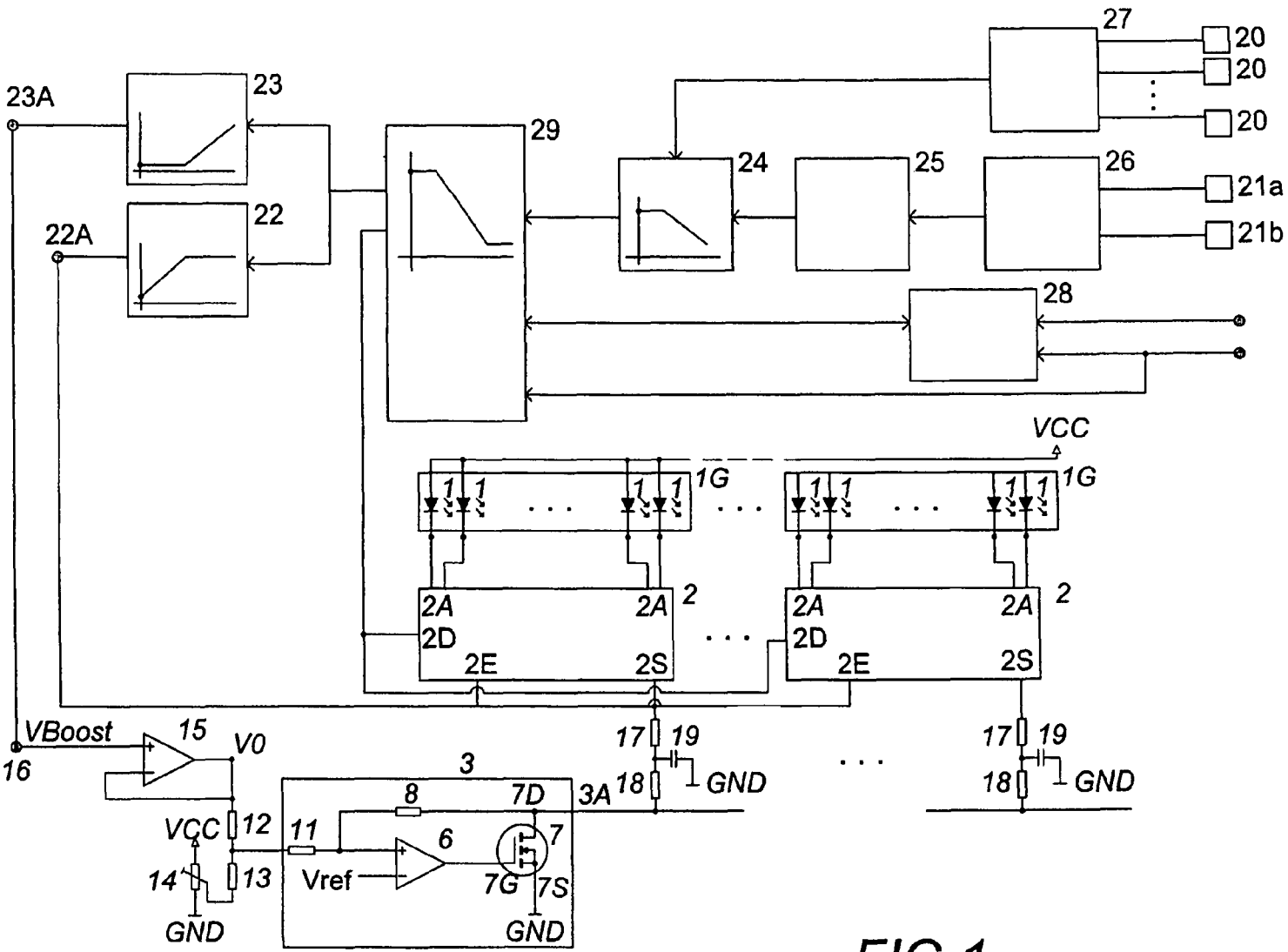
FIG. 1 shows a block diagram of an embodiment of the arrangement according to the invention.

As shown in FIG. 1, a group 1G of in each case sixteen LEDs 1 is controlled by a driver 2 which has outputs 2A to which the LEDs are connected. The drivers 2 include a slide register into which data are read via a serial data input 2D. Current can be supplied to the LEDs 1 in accordance with the data contained in the slide register.

The respective driver 2, which may be for example a low voltage 16 bit constant current LED sink driver SDP 16CP596 of the company ST has furthermore a control input 2S, which is connected to the output 3A of a voltage source 3. Altogether for example sixty LED groups 1G may be combined to a board 5 and controlled by a common voltage source 3. For suppressing disturbances and for a base setting of the current supplied by the driver 2 to the LEDs 1, the control input 2S of the driver 2 is connected to the output 3A of the voltage source 3 via an RC-network 17, 18, 19.

The voltage source 3 is formed in a conventional way. It includes a first operational amplifier 6 whose output is connected to the gate connection 7G of a field effect transistor and consequently controls the field effect transistor 7. The drain connection 7D of the field effect transistor 7, which, at the same time, forms the output 3A of the voltage source 3, is connected to the plus input of the first operational amplifier 6 via a resistor 8. The source connection 7S of the field effect transistor 7 is connected to ground. At the negative input of the first operational amplifier 6, a self-generated reference voltage $V_{Ref}$ is connected. The constant reference voltage $V_{ref}$ and the values of the components used in this circuit section (for example, resistance values) are so selected that, with a certain analog value of the input voltage $V_{Boost}$ at the control input 2S of the driver the desired respective analog voltage is obtained. The first operational amplifier 6 operates herein in combination with the field effect transistor 7 as an inverting amplifier.

The positive input of the first operation amplifier 6 is connected via a resistor 11 to a voltage divider consisting of two resistors 12, 13 and a potentiometer 14. The voltage divider is fed by a second operational amplifier 15, whose plus-input represents a boost input 16 of the voltage source 3. The negative input of the second operational amplifier 15 is connected to the output of the second operational amplifier 15. The second operational amplifier is consequently used as a voltage follower.

Depending on the voltage $V_{Boost}$ present at the boost input 16, the voltage applied by the voltage source 3 to the control inputs 2S of the drivers 2 can be adjusted. A base voltage applied with a first predetermined voltage $V_{Boost}$ to the boost input 16 by the voltage source 3 to the control input 2S of the drivers 2 can be adjusted by means of the potentiometer 14. That means that, by means of the potentiometer 14, the brightness of the LEDs present with the first predetermined voltage $V_{Boost}$ under the control of the respective drivers 2 can be adapted to the brightness of surrounding or, respectively, adjacent LEDs whose drivers are controlled by another voltage source and which are subjected to the same first predetermined voltage $V_{Boost}$.

The first predetermined voltage $V_{Boost}$ may for example be so selected that the LEDs 1 are operated by a current which cor-responds to about half the maximum admissible current. If the brightness of the LEDs 1 is to be increased because for example the brightness of the ambient light has become greater, the voltage $V_{Boost}$ is correspondingly increased. This causes an increase of the total voltage $V_o$ effective on the voltage divider whereby the voltage applied by the voltage source 3 to the control inputs 2S of the drivers 2 is increased so that the drivers 2 which are connected to the output 3A of the voltage source 3 all uniformly increase the current flow through the respective LEDs 1 controlled thereby, which results in a uniform brightness change of the respective LEDs.

The drivers 2 furthermore include activation inputs 2E which are connected to the output 22A of the pulse width modulator 22. By means of the activation inputs 2E, the current supplied to the LEDs 1 can be switched on or, respectively, switched off. When the PWM-signal is in its switch-on phase, that is on its "high" level, the driver 2 provides current to the LEDs 1 as determined by the content of the slide register. The average current supplied to the LEDs 1 and, consequently, the average brightness of the LEDs 1 as a result depends on the switch-on duration or, respectively, the keying ratio of the PWM signal.

The boost input 16 of the voltage source 3 is connected to the output 23A of a block 23. With the signal supplied to the block 23, the size (amplitude) of current supplied to the LEDs 1 can be adjusted. If a PWM signal is applied to the activation inputs 2E of the drivers 2, the amplitude of the pulse-width modulated current supplied to the LEDs 1 can be adjusted by means of the signal provided by the block 23.

The input of the pulse width modulator 22 as well as the input of the block 23 is connected to a control unit 29. Furthermore, the data inputs 2D of the drivers 2 are also connected to the control unit 29. In this way, the control unit 29 can load data into the slide registers of the drivers 2. The control unit 29 is further connected to the output of a counter 28 which counts the data loaded into the slide registers of the drivers 2, but only those data which have a state causing the respective LEDs 1 to be supplied with current. The respective pulses are applied to a first input of the counter 28. At a second input of the counter 28 as well as at another input of the control unit 29, a signal is present which indicates that an image is being terminated. By means of this signal, the counter state of the counter 28 is transmitted to the control unit 29 and is then set to zero.

In the control unit 29, the value of the counter 28 is compared with a predetermined value which is provided in the control unit 29 by a setting member 24 whose output is connected to the input of the control unit 29. The predetermined value corresponds to the maximum number of LEDs which, under the given limit conditions, can be concurrently supplied with current without exceeding the maximally admissible output capacity of the power supply providing current to the arrangement. If the value of the counter 29 is greater than the predetermined value, the control unit 29 causes the pulse width modulator 22 to issue a signal which reduces the average current supplied to the respective LEDs 1 to such an extent that the maximally admissible power output of the power supply is not exceeded. Depending on the size of the value of the counter 28, the control unit 28 may also cause the block 23 to reduce the voltage $V_{Boost}$ applied to the boost input 16.

The setting member 24 has a first input which is connected to the output of an average value generator 25. The average value generator forms the average value of signals provided by a brightness maximum value generator 26. To this end, the average of for example ten subsequent output signals of the brightness maximum value generator 26 is determined. With each average value formed which may occur for example once per second a new maximum value is taken into consideration and in each case, the oldest maximum value is removed from the calculation process.

The setting member 24 forms from the average value obtained from the average value generator 25 and from the temperature maximum value generator 27 the predetermined value which is supplied to the control unit 29. In other words, the setting member 24 forms, taking into consideration the parameters of the used power supply, the average brightness determined by the brightness sensors 21*a*, 21*b* and the maximum temperatures determined by the temperature sensors 20—in each case, the desired value (maximum value) of the number of LEDs which can be supplied by the respective power supply with the full (desired) current. Depending on this value, the control unit 29 controls the pulse width modulator 22 and the block 23.

The control is so established that, with a previously determined theoretical overload, first the voltage at the output 23*a* of the block 23 is reduced. In this way, in the end, the current supplied by the outputs 2*a* of the driver 2 to the LEDs 1 is reduced. The pulse-pause ratio of the pulse width modulator 22 at this point is 100% that is a constant output voltage is present at the output 22*a* of the pulse width modulator 22. This results in an uninterrupted supply of current provided by the drivers 2 to the LEDs 1.

If the load of the power supply needs to be further reduced either because of a rise in the temperature or the need of energizing an excessively large number of LEDs 1, the output voltage supplied by the block 23 is reduced until it reaches a minimum value. When the output voltage has reached the minimum value the pulse-pause ratio of the pulse width modulator 22 is reduced. That means that the LEDs are no longer energized by a continuous current but by an interrupted current.

Figure 2:
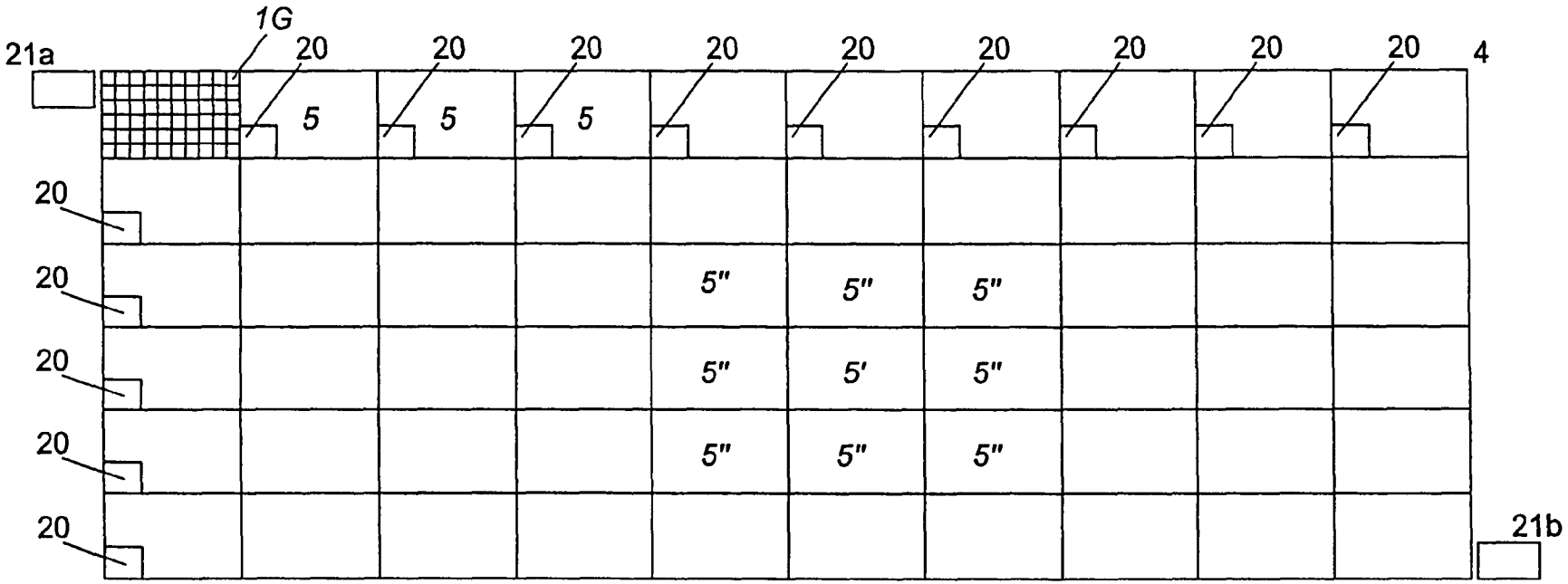
FIG. 2 is a schematic representation of an indicating table.

As shown in FIG. 2, a display board 4 comprises a plurality of boards 5 each of which comprise a plurality of groups 1G consisting of sixteen LEDs. An indicating table 4 may for example have six to sixty boards 5 wherein each board may include for example sixty groups 1G each comprising sixteen LEDs.

If, for example, the board indicated in FIG. 2 with the reference numeral 5' needs to be replaced by a new board, after the exchange of the board 5', the brightness of the LEDs present on the board 5' is adapted by means of the potentiometer 14 at the same predetermined voltage $V_{BOOSt}$ to the brightness of the adjacent boards 5".

On each board, there is a temperature sensor 20. Brightness sensors 21*a*, 21*b* are arranged at the diagonally opposite corners of the indicating table 4.

What is claimed is:

1. A control arrangement for controlling light emitting diodes (1) (LEDs) which are combined to a display board (4), said control arrangement comprising:

at least one driver (2) connected to a voltage source (3) and having current outputs (2A) via which current can be supplied to the LEDs (1) as well as at least one control input (2E) by way of which the current which can be supplied to the LEDs (1) is controllable, and a counter element (28) for determining the number of LEDs (1) which are to be supplied with current at the same time, said counter element (28) being connected via a control unit (29) to the at least one control input (2E) for supplying to the at least one driver (2) a signal which is indicative of the number of LEDs determined by the counter element (28) as being energized for limiting the current supplied to the LEDs depending on the number of LEDs being energized so as to avoid exceeding the maximally admissible output capacity of the voltage source.

2. An arrangement according to claim 1, wherein one of the control inputs (2E, 2S) of the driver (2) is an activation input (2E) by way of which the current, that can be supplied to the LEDs (1), is switchable.

3. An arrangement according to claim 1, wherein the driver (2) has a control input (2S) by which the current, that can be supplied to the LEDs (1), is adjustable and which is connected to an output (3A) of the voltage source (3).

4. An arrangement according to claim 3, wherein the voltage source (3) has a voltage source control input (3S) by way of which the output voltage of the voltage source (3) is controllable.

5. An arrangement according to claim 4, wherein the voltage source control input (3S) of the voltage source (3) is connected to an adjustable voltage divider (12, 13, 14) whose total voltage ($V_o$) is adjustable.

6. An arrangement according to claim 1, wherein there is at least one sensor (21*a*, 21*b*) for determining the ambient brightness of the LEDs (1), and a signal indicative of the ambient brightness can be supplied to the at least one control input (2E, 2S).

7. An arrangement according to claim 6, including an average value generator (25) for forming a time-based average value of the ambient brightness of the LEDs (1).

8. An arrangement according to claim 6, wherein there are several brightness sensors (21*a*, 21*b*) as well as a brightness maximum value former (26) for forming the maximum of the input signals of the several brightness sensors (21*a*, 21*b*).

9. An arrangement according to claim 1 including at least one temperature sensor for determining the ambient temperature of the LEDs (1) and a signal indicative of the ambient temperature can be supplied to the at least one control input (2E).

10. An arrangement according to claim 9, wherein several temperature sensors (20) are provided as well as a temperature maximum value former (27) for forming the maximum of the output signals of the several temperature sensors (20).

* * * * *